United States Patent [19]

Srour et al.

[11] Patent Number: 4,716,935

[45] Date of Patent: Jan. 5, 1988

[54] FLUIDIC RECTIFIER

[75] Inventors: Nassy Srour, Silver Spring; Tadeusz M. Drzewiecki, Rockville, both of Md.

[73] Assignee: United States of America as represented by the Secretary of the Army, Washington, D.C.

[21] Appl. No.: 19,847

[22] Filed: Feb. 27, 1987

[51] Int. Cl.[4] ..... F15C 1/04

[52] U.S. Cl. ..... 137/825; 137/833; 137/840; 137/842

[58] Field of Search ..... 137/803, 833, 840, 842, 137/825

[56] References Cited

U.S. PATENT DOCUMENTS 3,413,994 12/1968 Sowers, III ..... 137/825
3,583,419 6/1971 Griffin ..... 137/840

OTHER PUBLICATIONS

Willis A. Boothe and Carl G. Ringwall, "*Fluidic Carrier Techniques*", Mar. 1974, *Fluidic State-of-the-Art Symposium*, 1974, vol. III, pp. 332, 365.

R. F. Hellbaum, "*Experimental Design of Laminar Proportional Amplifiers*", Sep. 30-Oct. 3, 1974, *Fluidic State of the Art Symposium*, 1974, pp. 242, 245, 250, 266.

J. O. Gurney, Jr., "Photofluidic Interface", Mar. 1984, Journal of Dynamic Systems, Measurement, and Control, vol. 106, pp. 92-95.

*Primary Examiner*—A. Michael Chambers

*Attorney, Agent, or Firm*—Saul Elbaum; Thomas E. McDonald; Alan J. Kennedy

[57] ABSTRACT

A full wave fluidic rectifier which produces a direct fluidic output signal having an amplitude which increases from a very low level as the amplitude of an alternating fluidic input signal increases. In includes a nozzle for directing a fluid stream along the rectifier axis into a null venting outlet, two signal outlets which are symmetrically disposed in opposite sides of the null outlet, and two control signal inlets for applying the alternating input signal to the stream, deflecting the stream alternately toward the two signal outlets in proportion to the amplitude of the alternating input signal. The two signal outlets are connected by respective channels of equal fluid resistance to a common channel which serves as the rectifier output.

4 Claims, 6 Drawing Figures

FLUIDIC RECTIFIER

RIGHT OF THE GOVERNMENT

The invention described herein may be manufactured, used and licensed by or for the United States Government for governmental purposes without the payment to us of any royalty thereon.

BACKGROUND OF THE INVENTION

The invention relates in general to fluidic rectifiers, and, in particular, to a fluidic rectifier that develops an increasing output with increasing input amplitude.

Conventional fluidic amplifiers, such as described in the article "Fluidic Carrier Techniques" by W. A. Boothe and C. G. Ringwall, in the October 1974 *Proceedings of the HDL Fluidic State-of-the-Art Symposium,* Vol. III, pages 335–395, having a single output channel which is centered on the axis of the rectifier nozzle. These conventional fluidic rectifiers produce an output signal which is inversely porportional to the input signal amplitude. In other words, as the input signal amplitude increases, the DC level output signal decreases from a high level at zero input. In such fluidic amplifiers, it is difficult to detect and rectify very small amplitude input signals because the output is riding on a high level. Also, when there is a need to develop additional gain after the rectification process, it is difficult to amplify the rectified signal in a subsequent fluidic amplifier without swamping the input stage of the amplifier with an unwanted DC signal level.

In the past, bias levels in other devices such as fluidic amplifiers have been eliminated by using a center-dump to bleed off the pressure and flow. The outputs then only see differential changes around some low level. However, until the present invention, this center-dump concept has not been applied to fluidic rectifiers.

SUMMARY OF THE INVENTION

It is a primary object of the invention to provide a full wave fluidic rectifier which produces a direct fluidic output signal having an amplitude which increases from a very low level as the amplitude of an alternating fluidic input signal increases.

The rectifier includes an input end, an output end, and an axis extending therebetween. A null or dump outlet, which is symmetrically disposed on the axis at the rectifier output end, is connected to an ambient or ground pressure. This center vent is designed to accept the entire main jet flow so that no flow impinges on the signal outlets. First and second signal outlets, which are symmetrically disposed on opposite sides of the null outlet at the rectifier output end, are connected by respective channels of equal fluid resistance to a common channel which serves as the respective channels of equal fluid resistance to a common channel which serves as the rectifier output. A nozzle is disposed at the rectifier input end and connected to a source of pressurized fluid, to direct a jet stream of fluid along the axis into the null outlet. First and second control signal inlets, which are symmetrically disposed on opposite sides of the axis between the nozzle and the null outlet are connected to receive the alternating fluidic input signal, to apply this alternating input signal to the jet stream, deflecting the jet stream alternately toward the first and second output signal outlets in proportion to the amplitude of the alternating input signal.

When the pressurized fluid forming the jet stream is a gaseous medium, the common outlet channel may include an enlarged portion or chamber, which serves as a low pass filter to remove alternating components of the output signal, which occur at a frequency double the frequency of the alternating fluidic input signal.

BRIEF DESCRIPTION OF THE DRAWINGS

The invention will be better understood, and further objects, features and advantages of the invention will become more apparent from the following description of preferred embodiments, taken in conjunction with the accompanying drawings in which.

DESCRIPTION OF THE PREFERRED EMBODIMENT

Figure 1:
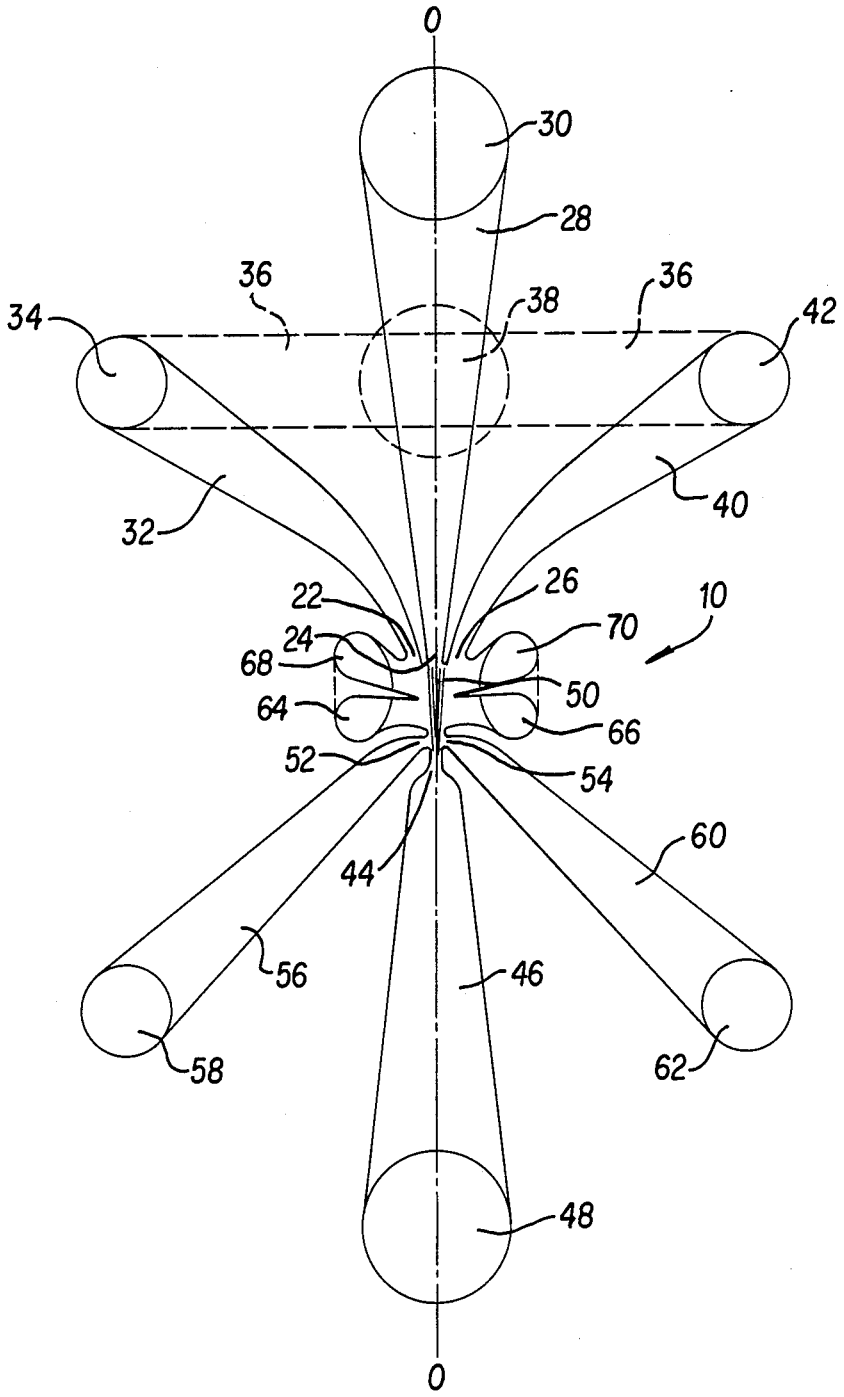
FIG. 1 is a plane view of a first embodiment of the invention.
Figure 2:
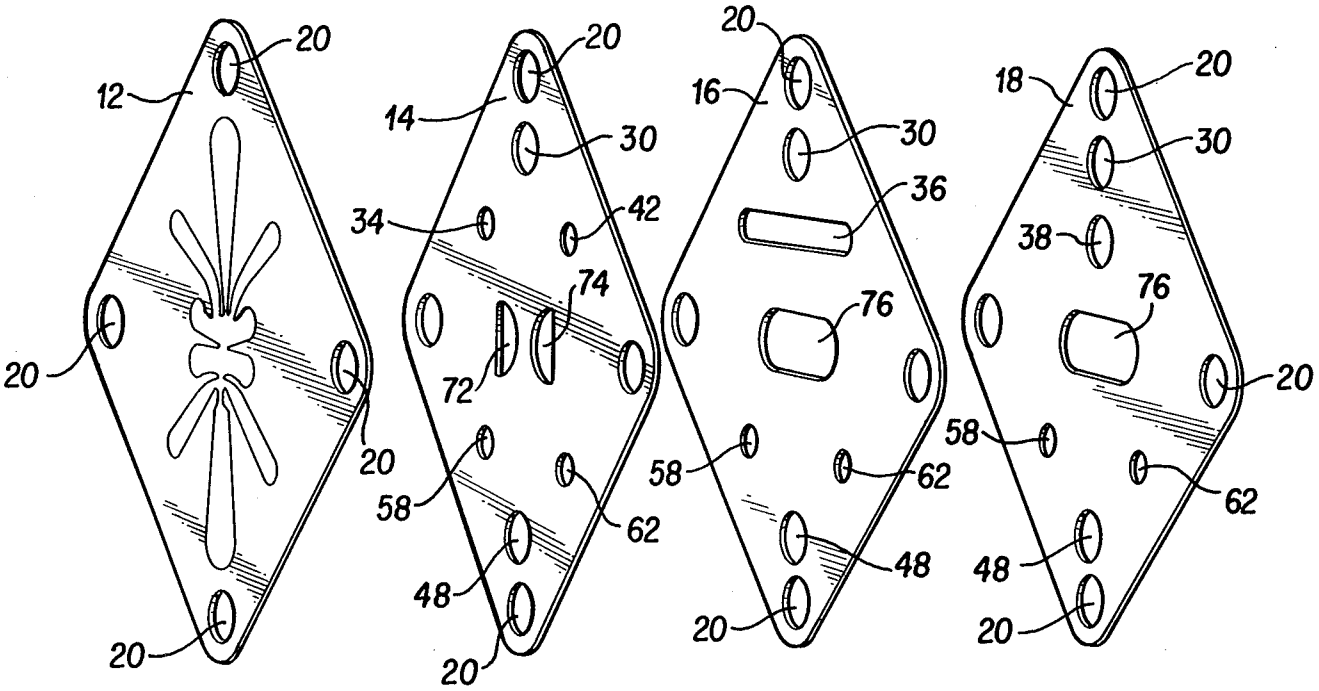
FIG. 2 is an exploded view of some of the plates which are assembled together to form the embodiment of FIG. 1.

The fluidic rectifier 10 shown in FIGS. 1 and 2 includes several formed metal plates, 12, 14, 16, and 18 which are aligned and stacked together by opposite end plates (not shown) and positioning rods which extend through circular corner openings 20 in the plates 12–18.

The plate 12 has formed therein three outlets 22, 24, 26 at the output end of the plate. The null or vent outlet 24 is symmetrically disposed on an axis O—O extending between the input and output ends of the plate 12 and is connected by a channel 28 and passageway 30 through the plates 14, 16 and 18 to ground. When the pressurized fluid utilized in the rectifier 10 is ari, the null outlet 24 is generally vented to the atmosphere. When the pressurized fluid is a liquid,t he null outlet 24 is generally connected to a sump connected with the inlet of a hydraulic pump.

The two signal outlets 22, 26 are symmetrically disposed on opposite sides of the null outlet 24 at a output end of the plate 12. The signal outlet 22 is connected by a passsage 32 formed in the plate 12, and opening 34 through the plate 14, and half of a passage 36 formed in the plate 16 to a rectifier outlet passage 38 extending through the plate 18. Similarly, the signal outlet 26 is connected by a passage 40 formed in the plate 12, and opening 42 extending through the plate 14, and the other half of the passage 36 formed in the plate to the rectifier outlet passage 38. The fluid resistance of the serially-connected passages 32, 34, and the one-half of channel 36 connecting the signal outlet 22 to the rectifier outlet channel 38 is the same as the fluid resistance of serially-connected passages 40, 42, and the other half of channel 36 connecting the signal outlet 26 to the rectifier outlet channel 38.

A nozzle 44 is symmetrically disposed on the axis O—O at the input end of the plate 12. The nozzle 44 is connected by a channel 46 formed in the plate 12, and a passage 48 formed through the plates 14, 16 and 18 to a source of pressurized fluid, so that the nozzle 44 directs a jet stream 50 of fluid along the axis O—O into the null outlet 24.

First and second control signal inlets 52, 54 are symmetrically disposed ono pposite sides of the axis O—O adjacent the nozzle 44. The first control signal inlet 52 is connected by a channel 56 in the plate 12 to a first control signal input channel 58, exyending through the plates 14, 16 and 18. Similarly, the second control signal inlet is connected by a channel 60 of the plate 12 to a second control signal input channel 62 extending through the plates 14, 16 and 18. The two control signal input channels 58, 62 are connected to receive an alternating fluidic input signal, to thus apply the alternating input signal to the jet stream 50, causing the jet stream 50 to deflect alternately towards the first and signal outlets 22, 26 in proportion to the amplitude of the alternating input signal.

The rectifier 10 also includes two sets of vents 64 and 66, 68 and 70, which are disposed on opposite sides of the jet stream 50 intermediate the control signal inlets 52, 54 and the outlets 22, 24, 26. The vents 64, 66, 68 and 70 are connected to ground through the two passages 72, 74 in the plate 14 and a common vent passage 76 in plates 16 and 18, to provide dumping points for fluid inside the rectifier 10.

Figure 3:
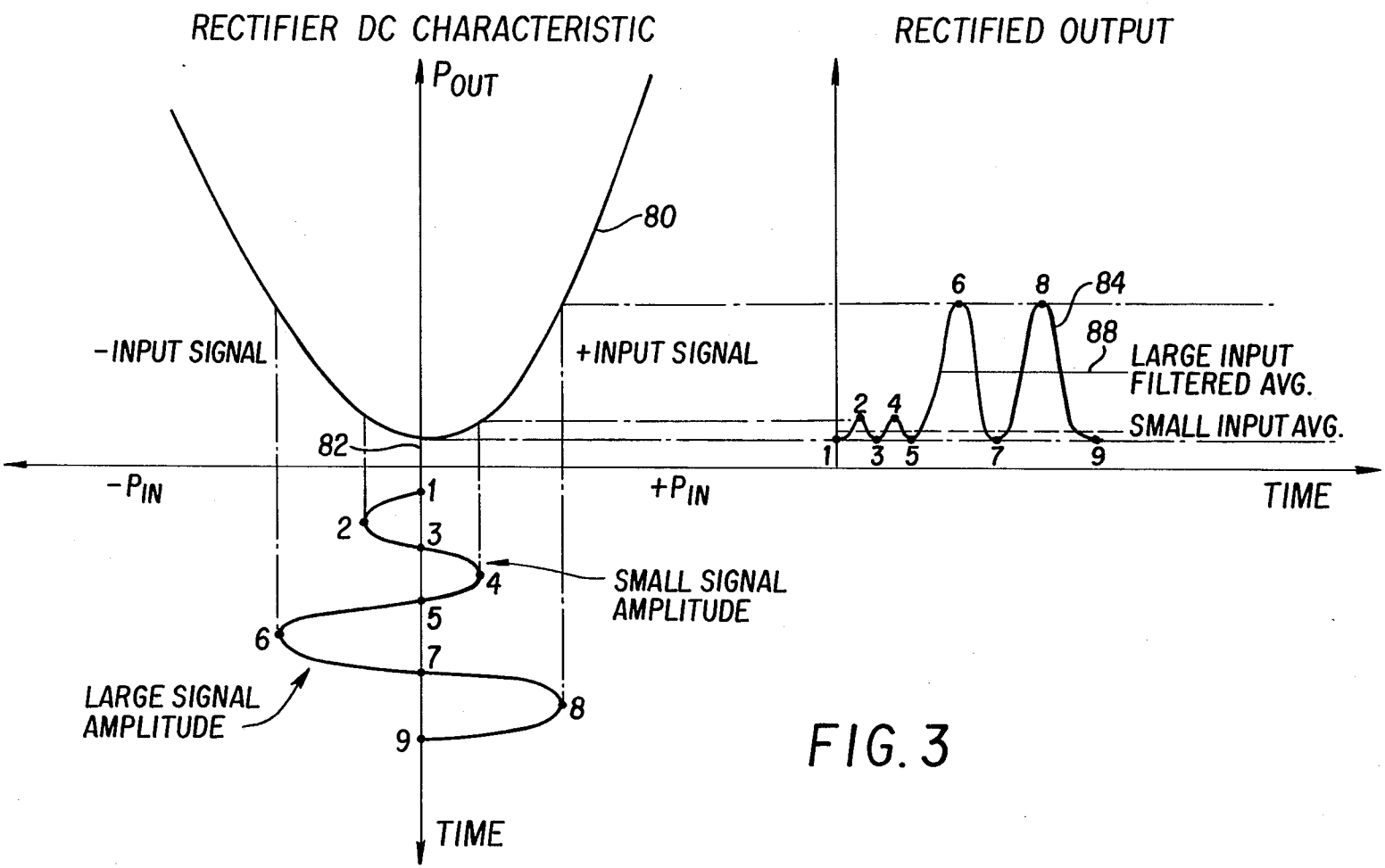
FIG. 3 is a graph of the output signal pressure versus the pressure of the alternating input signal, together with a plot of pressure versus time for the input and output signals.
Figure 4:
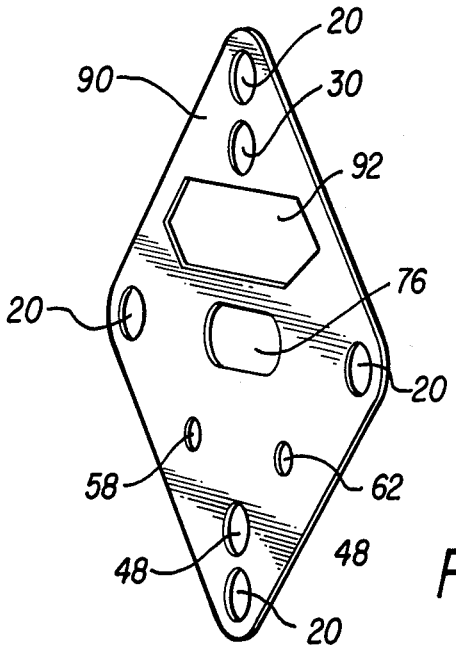
FIG. 4 shows a modification of the embodiment of FIG. 1.

FIG. 3 shows the DC characteristic curve 80 for a typical rectifier 10, obtained by plotting the pressure at the rectifier output 38 against the pressure of control signal applied across the control signal inputs 58, 62. As seen from this curve, the output pressure of the rectifier 10 will always be positive regardless of whether the input control signal is positive or negative with respect to ground. At zero input signal, there will be a small null output pressure 82, since there will always be some pressure drop through the null and vent outlets. As seen in this figure, the DC output signal 84 witll have an alternating frequency component which is double the frequency of the control input signal 86. An appropriate low pass filter can be used to filter the rectifier output signal to produce a smooth average output signal 88. When the pressurized fluid utilized in the rectifier 10 is a compressable fluid, such as air or other gaseous mixture, the low pass filter may consist merely of a pressure chamber. For example, referring to FIG. 4, in one or more plates 90, the channel 36 connecting the two passaggeways 34, 40 has been enlarged to form a chamber 92 which acts as a low pass filter. The volume of this chamber may be increased either by increasing the thickness of the plate 90 or by using several of these plates 90 stacked togther. When the preessurized fluid utilized by the rectifier 10 is a liquid, such as oil, a bellows-type low pass filter or the low-pass character of an amplifier or load can be used to smooth and filter the output signal of the rectifier.

Figure 5:
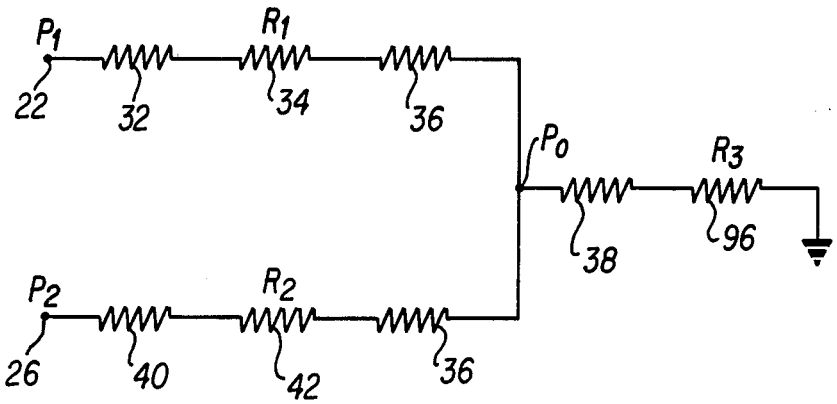
FIG. 5 is a schematic of a passive resistance summing network equivalent circuit of the output sections of the embodiment of FIG. 1.

The channels 32, 34, 36, 38, 40, and 42, together with the input resistance of a load 96 connected to the outlet of the rectifier 10, constitute a passive resistive summing network, as shown in FIG. 5. Resistance $R_1$, consisting of the passages 32, 34, and half of passage 36, is equal to the resistance $R_2$ consisting of the passages 40, 42, and the other half of passage 36. The output resistance $R_3$ is equal the resistance of the output channel 38 and the input resistance of a device 96 connected to the rectifier output. When the jet stream is deflected into the signal outlet 22, the pressure $P_1$ at this outlet will be a positive value above ground, while the pressure $P_2$ at the other signal outlet 26 will be essentially at ground. When the rectifier outlet is blocked ($R_3$ is decreased, the output pressure $P_o$ decreases. For example, when the outlet resistance $R_3$ is equal to $R_1$ or $R_2$, the output pressure $P_o$ will only be one third the value of the pressure $P_1$ at the outlet 22 into which the jet stream 50 is being directed. In view of this, it is suggested that the output resistance $R_3$ be substantially larger than the resistances $R_1$ or $R_2$.

Figure 6:
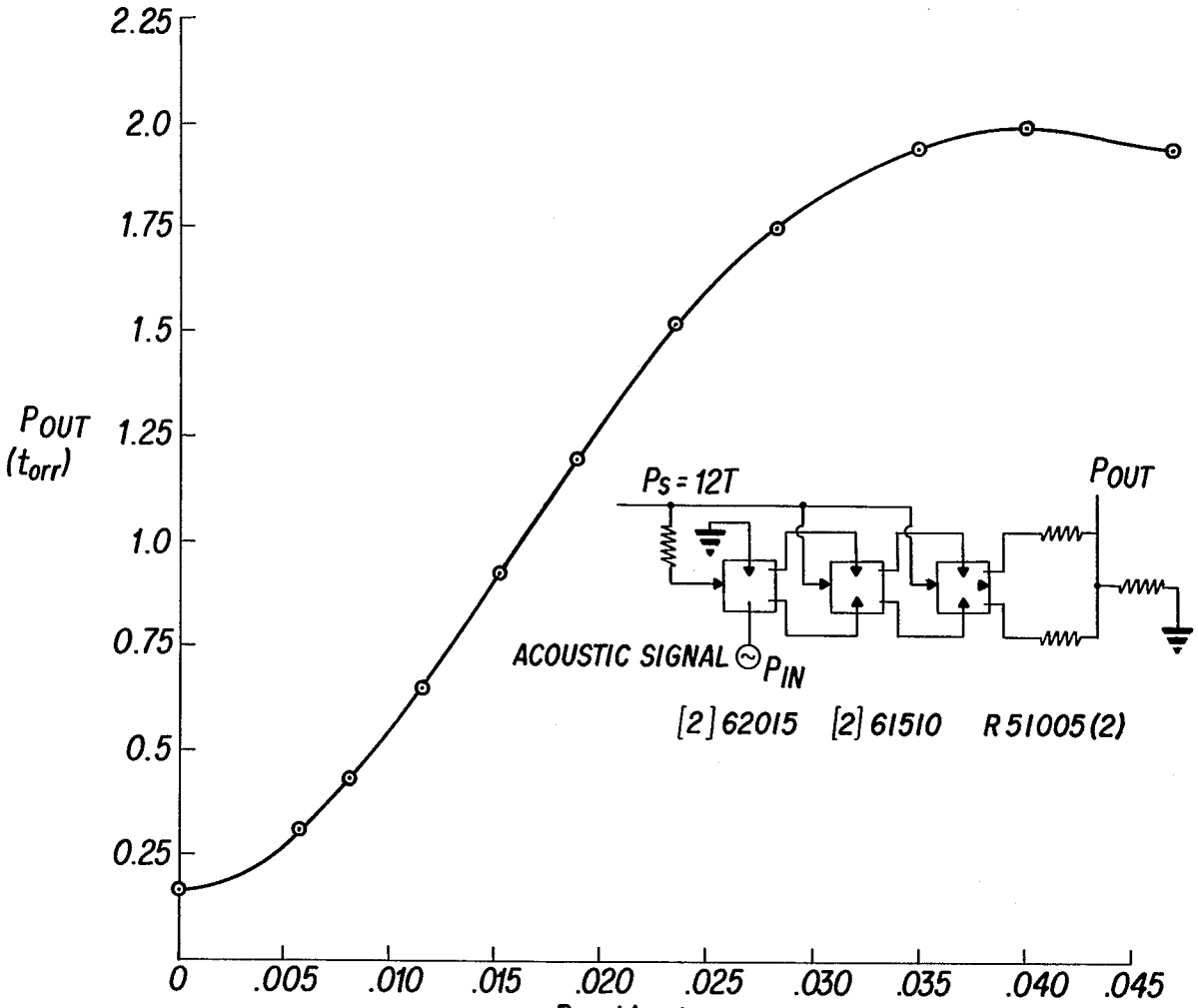
FIG. 6 is a plot of rectifier output pressure vs. input pressure to a 2-stage gain block driving the rectifier.

In operation, the input signal is often amplified by a gain block. For a typical 2-stage gain block driving a rectifier 10 operating at 12 Torr, the output level increases from about 0.2 Torr to 2 Torr with variations of input amplitude from 0 to 0.04 Torr as shown in FIG. 6.

Since there are various modifications and additions to the invention which would be obvious to one skilled in the art, it is intended that the scope for this invention be limited only by the appended claims.

What is claimed and desired to be secured by Letters Patent of the United States is:

1. A full wave fluidic rectifier for providing at a rectifier output a direct fluidic output signal having a level that increases as the amplitude of an alternating fluidic input signal increases, comprising:

an input end and an output end disposed on an axis extending therebetween;

a null venting outlet which is symmetrically disposed on the axis at the rectifier output end;

first and second signal outlets symmetrically disposed on opposite sides of the null outlet at the rectifier output end;

first and second channels, having equal fluid resistances, for respectively connecting the first and second signal outlets to a common rectifier output channel forming the rectifier output;

a nozzle, which is disposed at the rectifier input end and connected to a source of pressurized fluid, for directing a stream of fluid along the axis into the null outlet; and stream control means for applying the alternating input signal to the stream, deflecting the stream alternatively toward the first and second signal outlets in proportion to the amplitude of the alternating input signal.

2. A fluidic rectifier, as described in claim 1, wherein the stream control means comprises first and second control signal inlets, which are symmetrically disposed on opposite sides of the axis and which are connected to receive the alternating fluidic input signal.

3. A fluidic rectifier, as described in claim 1, wherein the rectifier output fluidic resistance, including the resistance of the common rectifier output channel and the input resistance of a load connected to the rectifier output, is greater than the fluidic resistance of the first or second channels.

4. A fluidic rectifier, as described in claim 1, wherein the common rectifier output channel includes low pass filter means for filtering the alternating component of the rectified fluidic output signal.

* * * * *